United States Patent [19]

Cochran

[11] 4,266,589

[45] May 12, 1981

[54] LIGHTWEIGHT GOLF BAG

[76] Inventor: Clifford E. Cochran, 3107 Habersham Hills, Cumming, Ga. 30130

[21] Appl. No.: 95,354

[22] Filed: Nov. 19, 1979

[51] Int. Cl.[3] ..... A63B 55/04

[52] U.S. Cl. ..... 150/1.5 B

[58] Field of Search ..... 150/1.5 R, 1.5 B, 1.5 C; 248/96

[56] References Cited

U.S. PATENT DOCUMENTS

| | | | |
|---|---|---|---|
| 2,186,491 | 1/1940 | Meyer | 150/1.5 B |
| 2,507,249 | 5/1950 | Dorazio | 150/1.5 R |
| 2,564,318 | 8/1951 | Wick | 150/1.5 B |

OTHER PUBLICATIONS

Twilight Golf Co. brochure, Oct. 24, 1958.
Eze-Kary Golf Bag brochure, Oct. 24, 1958.

*Primary Examiner*—Donald F. Norton
*Attorney, Agent, or Firm*—Jones, Thomas & Askew

[57] ABSTRACT

A lightweight self-standing golf bag having a flexible liner disposed within an external frame assembly. The liner is easily removable from the frame assembly for cleaning or replacement. The frame assembly includes a number of legs having pointed ends to support the golf bag in the ground, and has a number of frame members permanently attached to the legs.

3 Claims, 6 Drawing Figures

LIGHTWEIGHT GOLF BAG

BACKGROUND OF THE INVENTION

This invention relates in general to article carriers, and in particular to a lightweight carrier for articles such as golf clubs or the like.

Although golfers have available a wide selection of conventional golf bags for carrying their clubs, along with other articles such as golf balls and items of apparel, the conventional golf bags generally are relatively heavy and cumbersome. The weight and sheer physical bulk of the conventional golf bag, particularly when loaded with a full complement of clubs and accessories, is simply too great for the average golfer to carry personally while playing a round of golf. Moreover, the problems of personally carrying one's own golf bag are compounded by the fact that such bags are not self-supporting, particularly on the uneven terrain which characterizes most golf courses. Consequently, the golfer carrying his own bag must pick up and reshoulder the heavy bag after each shot, further adding to the burden of carrying the conventional golf bag and further reducing the golfer's enjoyment of the game.

While the golfer can overcome the foregoing problems by expedients such as hiring a caddy to carry the bag, or renting a motorized golf cart to carry bag and golfer about the course, such expedients are becoming increasingly more expensive and simply may not suit either the budget or the style of many casual or weekend golfers. The conventional hand-towed golf bag cart merely adds to the total weight which must be moved about the golf course.

Although golf bags have been proposed in an attempt to overcome many of the foregoing problems associated with conventional golf bags, such prior-art designs have generally been less than satisfactory for a number of reasons. Some such bags amount to little more than scaled-down versions of conventional full-size golf bags, sometimes with spiked feet added to engage the ground, and are still heavier than desirable for self-carrying by the average golfer. Moreover, the fabric or other material constituting the outermost surface of the typical prior-art lightweight golf bag is likely to become stained or soiled from use, and is difficult or impossible to remove from the bag for cleaning or replacement.

SUMMARY OF INVENTION

Stated in general terms, the golf bag of the present invention comprises an external skeletal frame defining a space, and a flexible liner removably attached to the frame to define a receptacle for carrying elongated articles such as golf clubs or the like. States somewhat more particularly, the frame of the present golf bag comprises a number of separate elongated members each connected to separate frame members adjacent the top, the bottom, and an intermediate location of the golf bag. The frame members may take the shape of annular or cylindrical bands which fit inside the tubular members and are secured thereto, so as to assist in defining the skeletal frame. The ends of the elongated tubular members are pointed to be readily driven into the ground, so that the present golf bag can be self-standing. The flexible liner fits within the frame members, and is removably attached to the uppermost frame member. The lowermost frame member defines a solid floor against which the lower end of the flexible liner rests, so that the weight of clubs or other articles within the liner is carried by the lowermost frame member rather than by the flexible liner itself. One or more pouches can be attached to the liner to protrude between the elongated members, so as to provide storage space for articles of clothing or the like.

Accordingly, it is an object of the present invention to provide an improved lightweight golf bag.

It is another object of the present invention to provide a lightweight golf bag in which the liner making up the enclosure portion of the bag is readily removable and replaceable.

Other objects and advantages of the present invention will become more apparent from the following description of the disclosed preferred embodiments of the invention.

DESCRIPTION OF PREFERRED EMBODIMENTS

Figure 1:
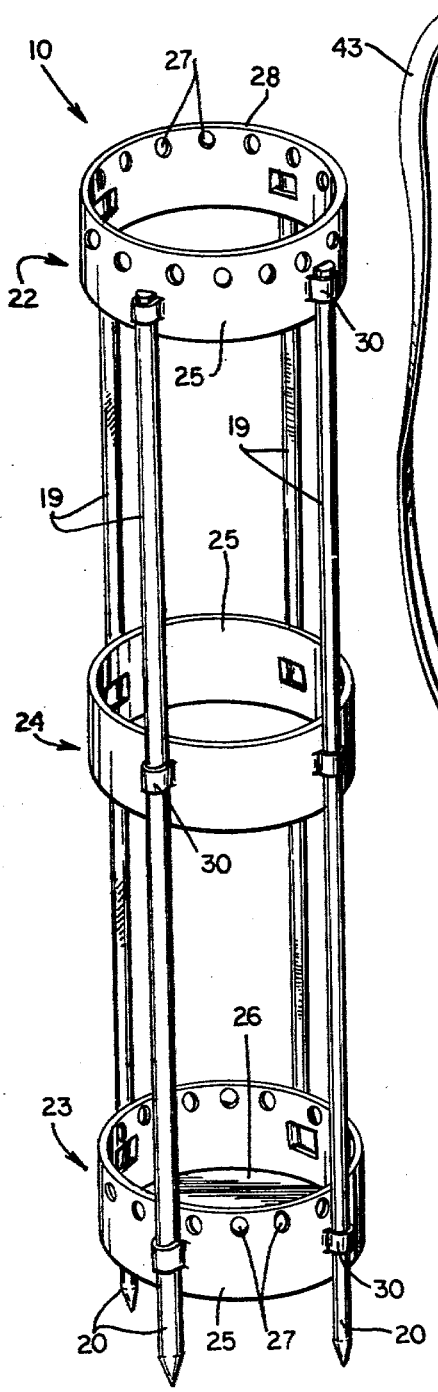
FIG. 1 is a pictorial view showing the frame assembly of a lightweight golf bag according to a first preferred embodiment of the present invention.
Figure 2:
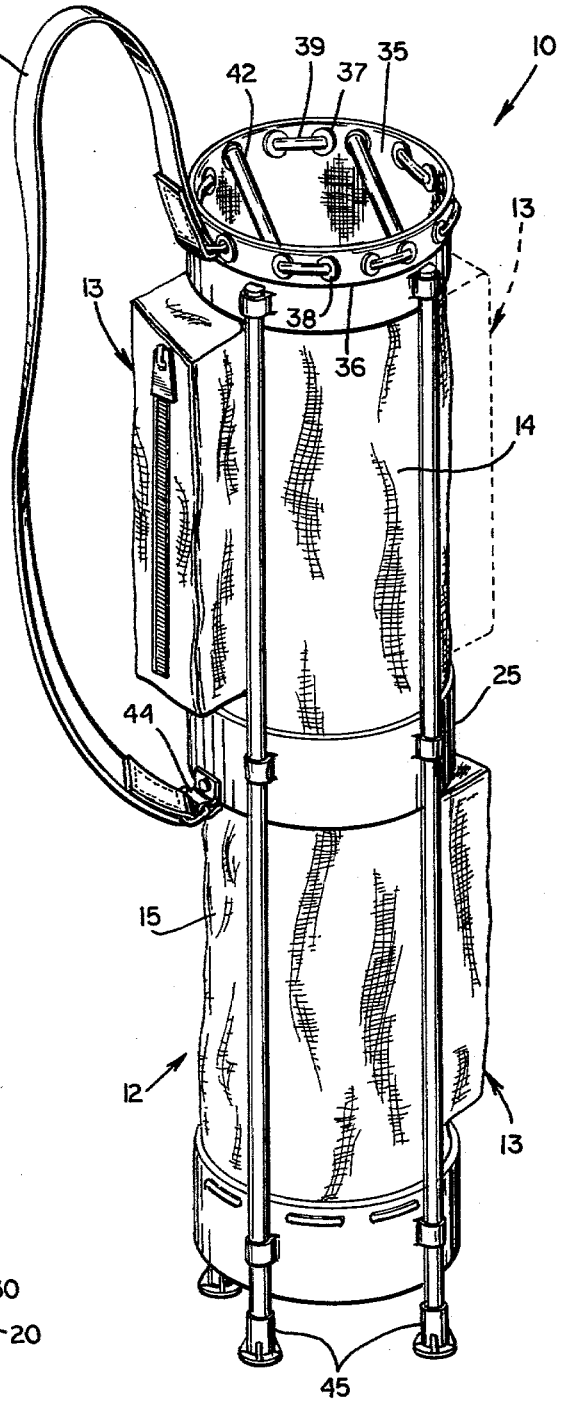
FIG. 2 is a pictorial view showing the complete golf bag utilizing the frame assembly shown in FIG. 1.

Turning first to FIGS. 1 and 2, there is seen generally at 10 a golf bag according to a first embodiment of the present invention. The golf bag 10 comprises a frame assembly 11, shown by itself in FIG. 1, and a flexible liner indicated generally at 12 and shown in FIG. 2 completely attached to the frame assembly. The liner assembly 12 includes one or more pockets or pouches collectively denoted at 13 and attached by any suitable means, such as stitching or the like, to the exterior surface 14 of the generally tubular flexible liner 15 which makes up the major portion of the flexible liner assembly. As is more clearly pointed out below, the liner assembly 12 is readily removable from the frame assembly 11 to facilitate cleaning or replacement of the liner assembly.

The frame assembly 11, as most clearly shown in FIG. 1, includes a number of elongated legs, being four in number in the disclosed embodiment and collectively designated 19. Each of the legs 19 is formed as an elongated solid rod for structural strength, in the disclosed embodiment, and is preferably extruded or otherwise fabricated from a suitable metal such as aluminum or the like for lightness combined with structural strength. The lower ends of the legs 19 are shaped to form points 20, so that the golf bag 10 can be self-supporting when the pointed legs are driven into the ground.

The several legs 19 making up the frame assembly 11 are each secured to an upper frame member 22, a lower frame member 23, and an intermediate frame member 24. Each of the three frame members in the disclosed embodiment includes an annular band 25 in the shape of a cylindrical section, and the lower frame member 23 has a bottom member 26 extending across the lower side of the band 25 to provide a floor in the lower frame member. The upper frame member 22 and the lower frame member 23 each have a circumferential row of radial openings 27 disposed a short distance downwardly from the upper edge of the band 25.

Figure 4:
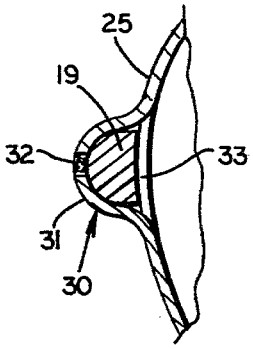
FIG. 4 is a fragmentary section view showing details of a typical support leg joined to one of the frame members, in the disclosed embodiments.

The legs 19 are permanently secured to each of the frame members by passing through brackets 30 on the exterior surface of each frame member. FIG. 4 shows in detail a typical bracket 30, having a generally C-shaped loop 31 formed integral with the annular band 25 of the frame member by any suitable fabricating technique such as die-punching or the like. The rod 19 is moved through the loop 31 to the position for proper location of the particular frame member, and the rod and loop are permanently secured by an appropriate fastening technique such as the pin 32, driven through the loop 31 and extending into the leg 19. The legs 19 are preferably extruded or otherwise formed to have a flat or curvilinear surface 33 which is complementary to the facing contiguous surface of the annular band 25 in each of the frame members, as best seen in FIG. 4, so that the space formed within each loop 31 is substantially occupied by the leg 19 extending therein.

The flexible liner assembly 12 is preferably fabricated from a relatively lightweight natural or aritifical material, or a mixture thereof, such as nylon or the like, which is preferably washable and is relatively durable without adding unwanted weight to the overall golf bag 10. The liner assembly 12 is open at its bottom end (not shown) adjacent the floor 26 of the lower frame member 23, so that golf clubs or other articles placed in the liner assembly are supported on the lower frame member.

The liner assembly 12 fits inside the annular bands 25 of the several frame members, and the open upper end 35 of the liner assembly extends beyond the top of the upper frame member 22 and is folded over to provide an inverted U-shaped lip 36 of liner material around the top edge 28 of the upper frame member 22. A cushion of resilient material, similar to the cushion 51 of the embodiment shown in FIG. 6, may be disposed about the top edge 28 beneath the fold of the liner assembly. The upper end 35 of the liner assembly 12 is provided with two rows of eyelet-equipped openings 37 and 38, best seen in FIG. 3, the openings 38 being longitudinally spaced a distance above the openings 37 so that when the upper end of the liner 15 is folded over the upper frame member 22 to form the lip 36, respective top edge 28 of the pairs of openings 37 and 38 are coaxially aligned with each other and with the openings 27 (FIG. 1) formed in the annular band 25 of the upper frame member.

Returning to FIG. 2 and FIG. 3, it is seen that an arrangement of lacing 39 extends through the coaxially aligned openings in the liner 15 and in the upper frame member 22, thereby securely yet removably attaching the liner assembly 12 to the frame assembly 11.

Figure 3:
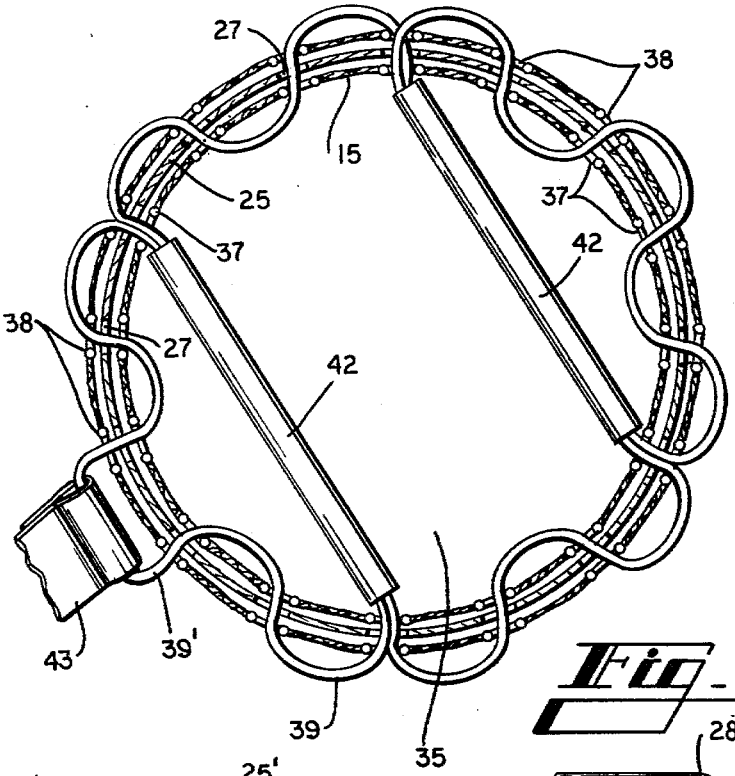
FIG. 3 is a top plan view showing the golf bag of FIG. 2.

One or more divider bars 42 may optionally be located across the open end 35 of the liner assembly 12, so as to divide the open end into segments which the golfer may conveniently use to segregate various types of clubs. The divider bars 42 are preferably made of a relatively lightweight and durable material such as polyvinyl chloride (PVC) or the like, and are maintained in place as shown in FIG. 3 by providing chordal paths for the lacing 39 extending across spaced-apart pairs of openings 37 and 38. A shoulder strap 43 can also be provided if desired. The shoulder strap can preferably be attached at its upper end to a loop 39' of the lacing, and at its lower end to a suitable bracket 44 attached to the intermediate frame member 24.

There has now been described a complete lightweight golf bag 10 in which the flexible liner assembly 12 is located within the surrounding protection of the frame assembly 11, so that the relatively durable frame assembly will help protect the liner assembly from abrasion or other damage whenever the golf bag is dropped or laid on its side. With its pointed feet 20, the golf bag is readily stood upright in the ground simply by pressing the frame assembly downwardly into the ground. Removable tips 45 can be provided for the points 20 to protect surrounding areas whenever the golf bag is carried in an automobile trunk, or rested on a floor.

Figure 5:
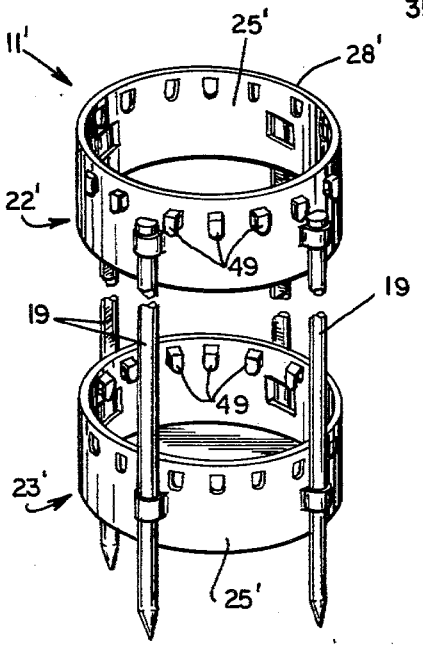
FIG. 5 shows a partially broken-away pictorial view of the frame assembly for a lightweight golf bag according to a second disclosed embodiment of the present invention.
Figure 6:
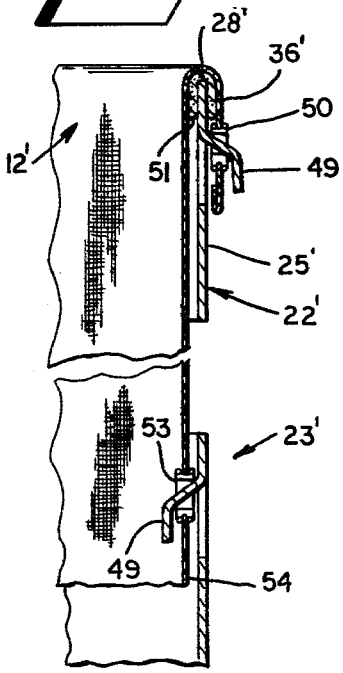
FIG. 6 shows a partially broken-away vertical section view of a complete lightweight golf bag according to the second embodiment, and utilizing the frame assembly shown in FIG. 5.

Turning next to FIGS. 5 and 6, there is shown another embodiment of the present invention in which alternative means are provided for removably interconnecting the flexible liner assembly 12' with the frame assembly 11'. The frame assembly 11' includes an upper frame member 22', a lower frame member 23', and an intermediate frame member (not shown) all permanently attached to legs 19', in a manner corresponding to that of the foregoing embodiment. The upper and lower frame members 22' and 23', however, have a plurality of downwardly-extending fingers 49 formed in the annular bands 25' of the respective frame members, in place of the openings 27 formed in the corresponding frame members of the embodiment shown in FIGS. 1–4. The fingers 49 of the upper frame member 22' extend outwardly therefrom, while the corresponding fingers of the lower frame member 23' extend inwardly therefrom. The fingers 49 of each frame member may be formed therein by die-punching or the like.

Turning to FIG. 6, the flexible liner assembly 12 contains a single row of eyelet-equipped openings 50 formed in the loop 36' of liner material extending downwardly around the exterior of the annular band 25' of the upper frame member 22'. A cushion 51 of relatively resilient material such as foam rubber or the like, in the shape of an inverted U, may advantageously be disposed about the top edge 28' of the band 25', to lessen the chance that the liner material may become cut or otherwise damaged at that point, and it should be understood that a similar cushion may also advantageously be provided in the embodiment shown in FIGS. 1–4.

Another row of eyelet-equpped openings 53 is formed in the liner assembly 12 a short distance above the lower end 54 thereof. It will now be apparent, particularly from FIG. 6, that the openings 53 are engaged by each of the inwardly-facing and downwardly-extending fingers 49 of the lower frame member 23', at the same time that the corresponding outwardly-facing fingers of the upper frame assembly 22' engage the openings 50 at the upper end of the liner assembly 12'. The material of the liner assembly 12' is sufficiently resilient to permit the liner assembly to stretch during attachment to or removal from the frame assembly 11', and to return to the normal position shown in FIG. 6 for retaining the liner assembly in place on the frame assembly.

It should be apparent that the foregoing relates only to preferred embodiments of the present invention, and that numerous changes and modifications may be made therein without departing from the spirit and the scope of the invention as defined in the following claims:

I claim:

1. A lightweight carrier for golf clubs or the like, comprising:

a plurality of elongated structural members extending substantially the length of the carrier;

first and second frame members connected to said elongated members adjacent the top ends and the bottom ends thereof, in position to maintain said elongated members in fixed spaced apart relation so as to define a spatial volume between the elongated members;

liner means disposed within said spatial volume and removably retained therein by securement to at least one of said frame members, thereby to define a receptacle for storing elongated articles such as golf clubs;

said elongated members being disposed to define a substantially cylindrical spatial volume;

said first frame member comprising a cylindrical band defining an opening for said spatial volume;

said liner means comprising a flexible liner which fits through said cylindrical band to be received within said volume; and cooperating means on said cylindrical band and on the continguous end of said flexible liner to detachably secure the flexible liner with the volume;

said cooperative means comprising:

a plurality of projections extending outwardly and downwardly on the exterior of said cylindrical band;

a plurality of openings formed in said flexible liner adjacent the upper end thereof, in alignment with said projections so that the openings engage and are retained by said projections when the upper end of the liner is folded over and downwardly along the exterior of said cylindrical band; and further comprising a plurality of projections extending inwardly and downwardly on the interior of said second frame member adjacent the lower end of said flexible liner; and a plurality of openings formed in said flexible liner for engagement by said projections on said second frame member.

2. A lightweight carrier for golf clubs or the like, comprising:

a plurality of elongated structural members extending substantially the length of the carrier;

first and second frame members connected to said elongated members adjacent the top ends and the bottom ends thereof, in position to maintain said elongated members in fixed spaced apart relation so as to define a spatial volume between the elongated members;

liner means disposed within said spatial volume and removably retained therein by securement to at least one of said frame members, thereby to define a receptacle for storing elongated articles such as golf clubs;

said elongated members being disposed to define a substantially cylindrical spatial volume;

said first frame member comprising cylindrical band defining an opening for said spatial volume;

said liner means comprising a flexible liner which fits through said cylindrical band to be received within said volume;

cooperating means on said cylindrical band and on the contiguous end of said flexible liner to detachably secure the flexible liner within the volume, said cooperative means comprising:

a plurality of openings formed in said cylindrical band;

two sets of plural openings formed in said flexible liner;

each set corresponding in alignment with said openings in said cylindrical band and one such set being spaced a distance above the other set so that the open upper end of said flexible liner is folded over and along the outside of said cylindrical band with the two sets of openings coaxially aligned with each other and with said plurality of openings in said cylindrical band; and means disposed in said aligned openings to maintain said upper end of said flexible liner on said cylindrical band.

3. A carrier as in claim 2, further comprising at least one member disposed across the open upper end of said flexible liner, so as to divide said open upper end into two separate opening portions.

* * * * *